US012220089B2

(12) United States Patent
Schomburg et al.

(10) Patent No.: US 12,220,089 B2
(45) **Date of Patent: *Feb. 11, 2025**

(54) HAND WASH STATION

(71) Applicant: SATELLITE INDUSTRIES, INC., Minneapolis, MN (US)

(72) Inventors: Kenneth V. Schomburg, Plymouth, MN (US); Everett A. Spandl, Hopkins, MN (US); Justin P. Jagels, Arkansas City, KS (US)

(73) Assignee: Satellite Industries, Inc., Minneapolis, MN (US)

( * ) Notice: Subject to any disclaimer, the term of this patent is extended or adjusted under 35 U.S.C. 154(b) by 213 days.

This patent is subject to a terminal disclaimer.

(21) Appl. No.: 18/091,273

(22) Filed: Dec. 29, 2022

(65) Prior Publication Data

US 2023/0136174 A1 May 4, 2023

Related U.S. Application Data

(63) Continuation of application No. 17/356,456, filed on Jun. 23, 2021, now Pat. No. 11,540,671.

(60) Provisional application No. 63/043,710, filed on Jun. 24, 2020.

(51) Int. Cl.

| | |
|---|---|
| ***A47K 1/02*** | (2006.01) |
| ***A47K 1/08*** | (2006.01) |
| ***A47K 5/12*** | (2006.01) |
| ***A47K 10/32*** | (2006.01) |

(52) U.S. Cl.

CPC ..... *A47K 1/02* (2013.01); *A47K 1/08* (2013.01); *A47K 5/1202* (2013.01); *A47K 10/32* (2013.01)

(58) Field of Classification Search

CPC ..... A47K 1/02; A47K 1/08; A47K 5/1202; A47K 10/32

USPC ..... 4/625–627

See application file for complete search history.

(56) References Cited

U.S. PATENT DOCUMENTS

| | | | | |
|---|---|---|---|---|
| D315,196 | S * | 3/1991 | Tegg | D32/35 |
| 5,687,434 | A * | 11/1997 | Tagg | A47K 1/02 4/625 |
| 6,401,274 | B1 * | 6/2002 | Brown | A47K 1/02 4/625 |
| 11,540,671 | B2 * | 1/2023 | Schomburg | A47K 1/02 |
| 2007/0199146 | A1 * | 8/2007 | Kostelyk | A47K 1/02 4/625 |

* cited by examiner

*Primary Examiner* — Tuan N Nguyen

(74) *Attorney, Agent, or Firm* — Skaar Ulbrich Macari, P.A.

(57) ABSTRACT

A portable hand wash station includes a base that can set upon the ground. A fresh water tank and greywater tank are disposed atop the base. A tank cover is disposed atop the tanks. The sink member is pivotally mounted to the tank cover. The sink member defines two sink basins that oppose one another. Each sink basin can be shaped and sized to allow the user to wash their forearms. A backsplash member can be secured to the sink member between the individual sink basins. The fresh water tank access can be secured by locking the sink member to the tank cover. A plurality of rods secure the tanks in place between the base and tank cover without protruding through a sidewall of the tanks.

20 Claims, 16 Drawing Sheets

HAND WASH STATION

PRIORITY

This application is a continuation of U.S. patent application Ser. No. 17/356,456, filed Jun. 23, 2021, which claims the priority benefit of U.S. Provisional Application No. 63/043,710, filed on Jun. 24, 2020, and both of which are hereby incorporated herein by reference in their entirety.

FIELD

The present invention relates to hand wash stations, and more particularly to portable hand wash stations.

BACKGROUND

There is a need to provide temporary and/or portable hand wash stations in a variety of environments. For example, in a location where many people will gather, or near a portable restroom, there is a need for persons to sanitize their hands. In such locations, there may not be access to electrical power and water plumbing. The need for a hand wash station in such location may also not be permanent. Thus, it is known to provide a portable hand wash station that has onboard tanks for clean wash water and the used or waste water (greywater). There is a continuing need to improve the functionality, manufacturability and serviceability of portable hand wash stations.

SUMMARY

The present invention provides an improved portable hand wash station. In one example, a portable hand wash station includes a base that can be set upon the ground. A fresh water tank and greywater tank are disposed atop the base. A tank cover is disposed atop the tanks. The sink member is pivotally mounted to the tank cover with a plurality of hinges. The sink member defines two sink basins that oppose one another. Each sink basin can be shaped and sized to allow the user to wash their forearms. A backsplash member is secured to the sink member between the individual sink basins. The fresh water tank access can be secured by locking the sink member to the tank cover. A plurality of elongated rods secure the tanks in place between the base and tank cover without protruding into the tanks.

In another example, a portable hand wash station can include a base, a fresh water tank disposed atop the base, a greywater tank disposed atop the base and horizontally adjacent to the fresh water tank, a tank cover disposed atop the fresh water tank and the greywater tank, and a sink member disposed atop the tank cover and secured to the tank cover via a hinge. The hinge allows the sink member to pivot with respect to the tank cover. The sink member defines a pair of sink basins disposed opposite one another.

A backsplash member can be secured to the sink member and located horizontally between the pair of sink basins. The backsplash member can define a plurality of downwardly-protruding post portions. The sink member can define a plurality of recesses. Each of the plurality of downwardly-protruding post portions can be sized and shaped to mate with a respective one of the plurality of recesses.

One or more of a towel dispenser, a soap dispenser, and a hand sanitizer dispenser can be mounted to each of a pair of opposing sides of the backsplash member at a location vertically above the sink basins. A fresh water fill cap can be disposed in a top surface of the fresh water tank such that it protrudes vertically through the tank cover while being covered by the sink member when the sink member is in a non-pivoted state with respect to the tank cover.

The tank cover can define a trough that is located such that water from the pair of sink basis drains directly into the trough and is routed by the trough to a greywater inlet of the greywater tank.

A plurality of elongated rods can be provided that span from the tank cover to the base. The elongated rods secure the fresh water tank and the greywater tank in place atop the base. The plurality of rods never pass through a sidewall of either the fresh water tank or the greywater tank.

A first foot pump can be provided to the base on a first side and a second foot pump can be provided to the base on a second side that is opposite the first side.

A pair of faucets can be provided, wherein each one of the pair of faucets is disposed adjacent to a respective one of the pair of sink basins.

A locking latch can be located opposite the hinge to secure the sink member atop the tank cover such that the sink member cannot pivot with respect to the tank cover.

A tether can be secured to a top side of the tank cover and to the sink member. The tether defines a maximum pivot range of the sink member with respect to the tank cover.

A suction port can be defined in greywater tank at a location adjacent to the base.

A plurality of stake down holes can be defined in the base.

Each of the fresh water tank and the greywater tank can be configured to define an outwardly-facing recess in a sidewall to provide clearance for a portion of a toilet seat when the portable hand wash station is placed inside of a portable restroom with a door of the portable restroom closed.

Each of the fresh water tank, the greywater tank, the base, the tank cover and the sink member can be formed via a blow-molding process.

Each of the pair of sink basins can be elongated horizontally toward opposing lateral sides of the sink member sufficient to allow a forearm of an adult human to be washed in the sink basin.

In another example, a method of forming a hand wash station can include forming each of a fresh water tank, a greywater tank, a base, a tank cover and a sink member via a blow-molding process, disposing the fresh water tank atop the base, disposing the greywater tank atop the base such that the greywater tank is horizontally adjacent to the fresh water tank, disposing the tank cover atop the fresh water tank and the greywater tank, disposing the sink member atop the tank cover, and securing the fresh water tank and the greywater tank between the base and the tank cover with a plurality of rods spanning from the base to the tank cover such that none of the plurality of rods passes through a sidewall of either the fresh water tank or the greywater tank.

The sink member can be secured atop the tank cover via a pivotable hinge on a first side of the sink member and via a locking latch on an opposing second side of the sink member.

A backsplash member can be secured to the sink member at a position located horizontally between the pair of sink basins by mating a plurality of downwardly-protruding post portions of the backsplash member with a respective plurality of recesses defined in the sink member.

Additional features, benefits and examples are described in the Detailed Description section below and will be apparent from the appended drawings.

The above summary is not intended to limit the scope of the invention, or describe each embodiment, aspect, implementation, feature or advantage of the invention. The detailed technology and preferred embodiments for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

Figure 1:
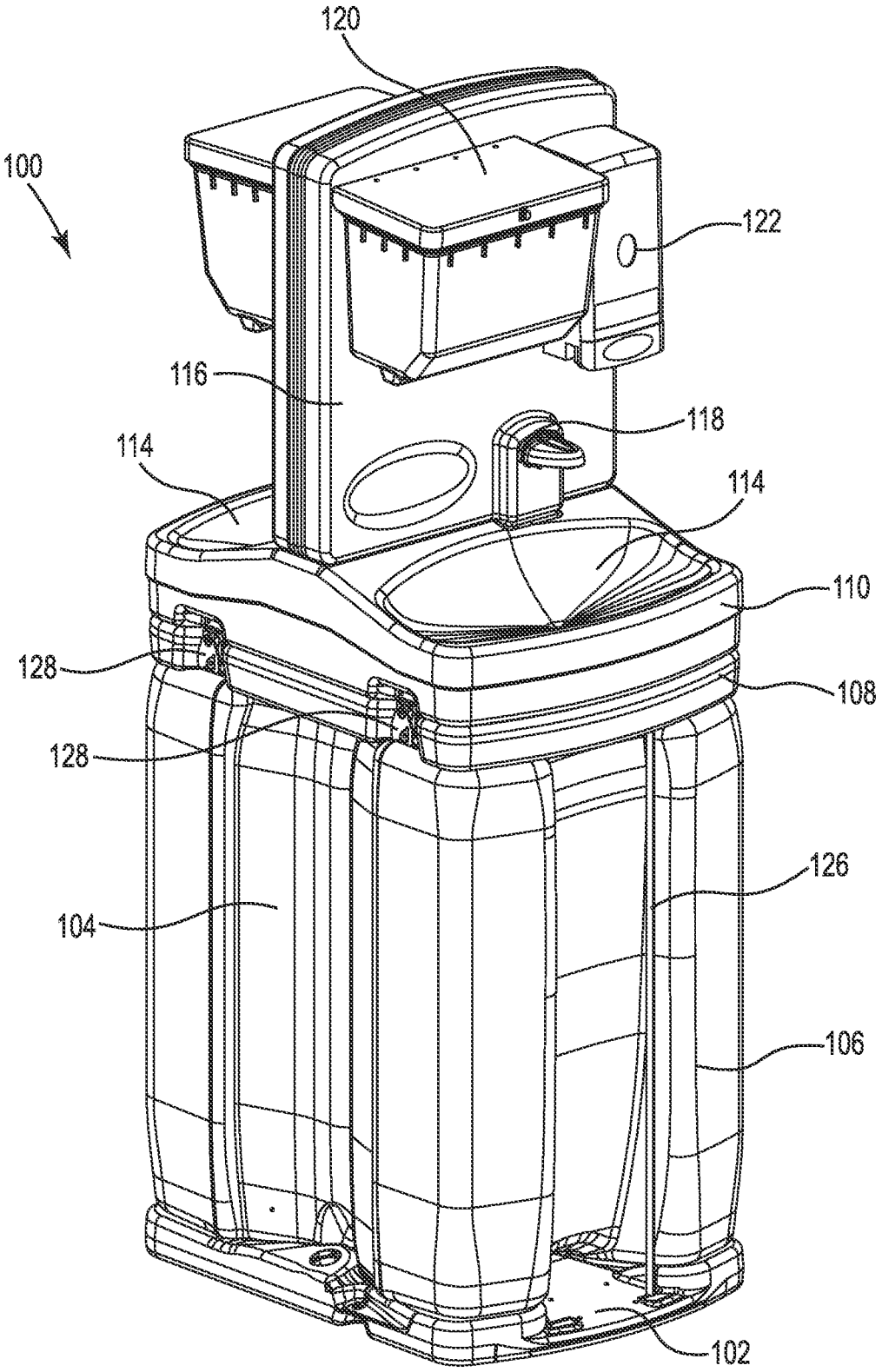
FIG. 1 is a perspective view of a hand wash station according to certain embodiments.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the scope of the invention as defined by the appended claims.

DETAILED DESCRIPTION

In the following descriptions, the present invention will be explained with reference to various exemplary embodiments. Nevertheless, these embodiments are not intended to limit the present invention to any specific example, environment, application, or particular implementation described herein. Therefore, descriptions of these example embodiments are only provided for purpose of illustration rather than to limit the present invention.

Referring to FIGS. 1-13, a portable hand wash station 100 according to certain embodiments is shown. The hand wash station 100 generally comprises a base 102 that sets upon the ground. The fresh water tank 104 and greywater tank 106 are each disposed atop the base 102. A tank cover 108 is disposed atop the fresh 104 and greywater 106 tanks.

The sink member 110 is pivotally mounted to the tank cover 108, atop the tank cover 108, with a plurality of hinges 112. Three hinges 112 are depicted, but more or fewer number of hinges can be used as well. The sink member 110 defines two sink basins 114 that oppose one another. Each sink basin 114 can be shaped and sized to allow the user to wash their forearms. For example each sing basin 114 can be an oval or elliptical shape that spans the majority of the lateral width of the sink member 110.

A backsplash member 116 is secured to the sink member 110 between the individual sink basins 114. The sink member 110 and backsplash member 116 can also be formed as a single part. The backsplash member 116 extends horizontally the approximately the lateral width of the sink member 110 and vertically upward from the sink member 110. The backsplash member 116 defines opposing surfaces to which accessories can be mounted, as will be explained later herein.

As shown in FIGS. 2-8, a reinforcing bracket 117 can be secured commonly to the lateral sides of the backsplash member 116 and the sink member 110 with a plurality of fasteners (e.g., screws) to enhance the rigidity of the backsplash member 116 atop the sink member 110. The reinforcing brackets 117 can be metal plates or other stiff and durable material, such as certain plastics, fiberglass, carbon fiber, etc.

A faucet 118 is disposed adjacent to each sink basin 114. The faucets 118 can be separate components secured to the sink member 110 and/or the backsplash member 116, or the faucets 118 can be formed at least partially integrally with the backsplash member 116.

Accessories such as towel dispenser 120 and soap dispenser 122 (or hand sanitizer dispenser) are mounted to each flat side of the backsplash member 116 above the sink basins 114.

A foot pump 124 is provided to the base 102 on each side of the hand wash station. The foot pumps can be riveted directly to the base 102 for rugged assembly. The user pushes on the foot pump 124 to cause water from the fresh water tank to emit from the faucet 118 connected to that particular foot pump 124.

The two water tanks 104, 106 are secured together between the base 102 and the top cover 108 via a plurality of elongated rods 126 spanning from the base 102 to the top cover 108. Each rod 126 is positioned adjacent to an outer side surface of one of the tanks and secured on one end to the base 102 and the opposing end to the top cover 108 to sandwich the tanks 104, 106 there between. The rods 126 can be formed, for example, of rigid material such as a metal.

Figure 8:
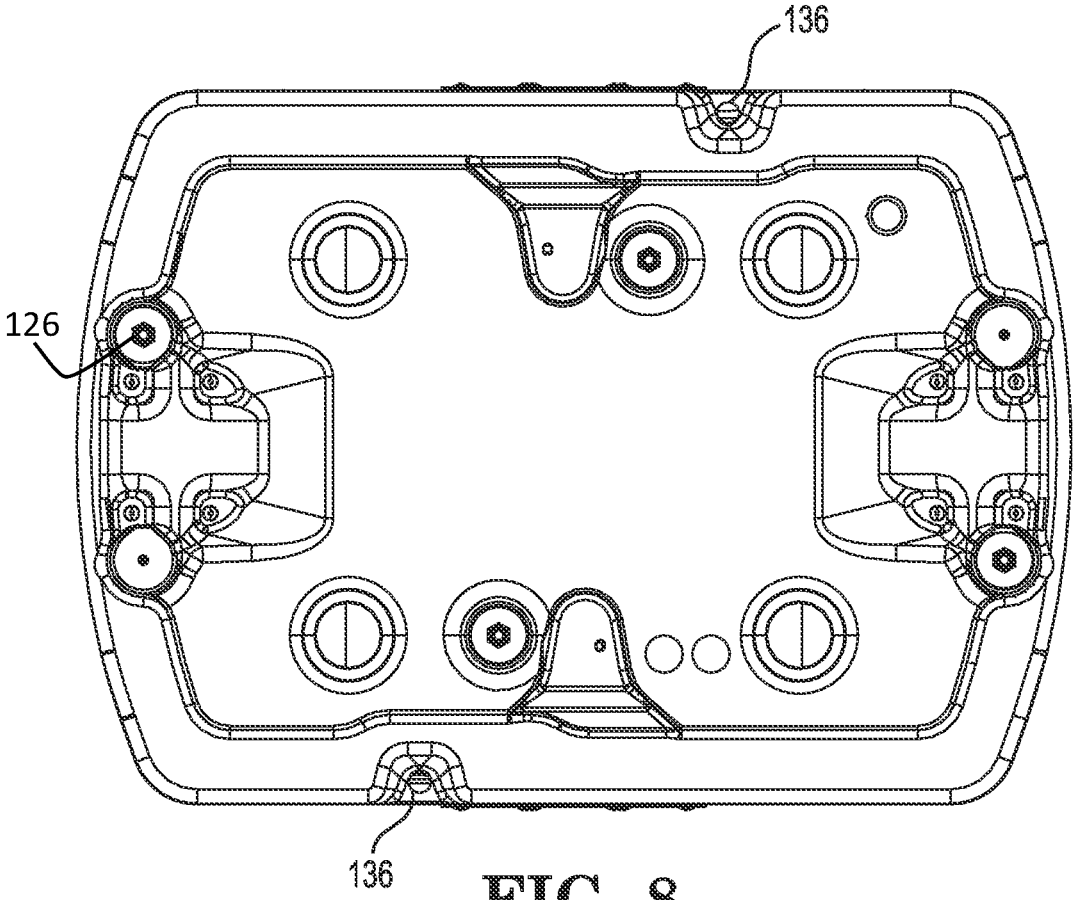
FIG. 8 is a bottom view of the hand wash station of FIG. 2 according to certain embodiments.
Figure 9:
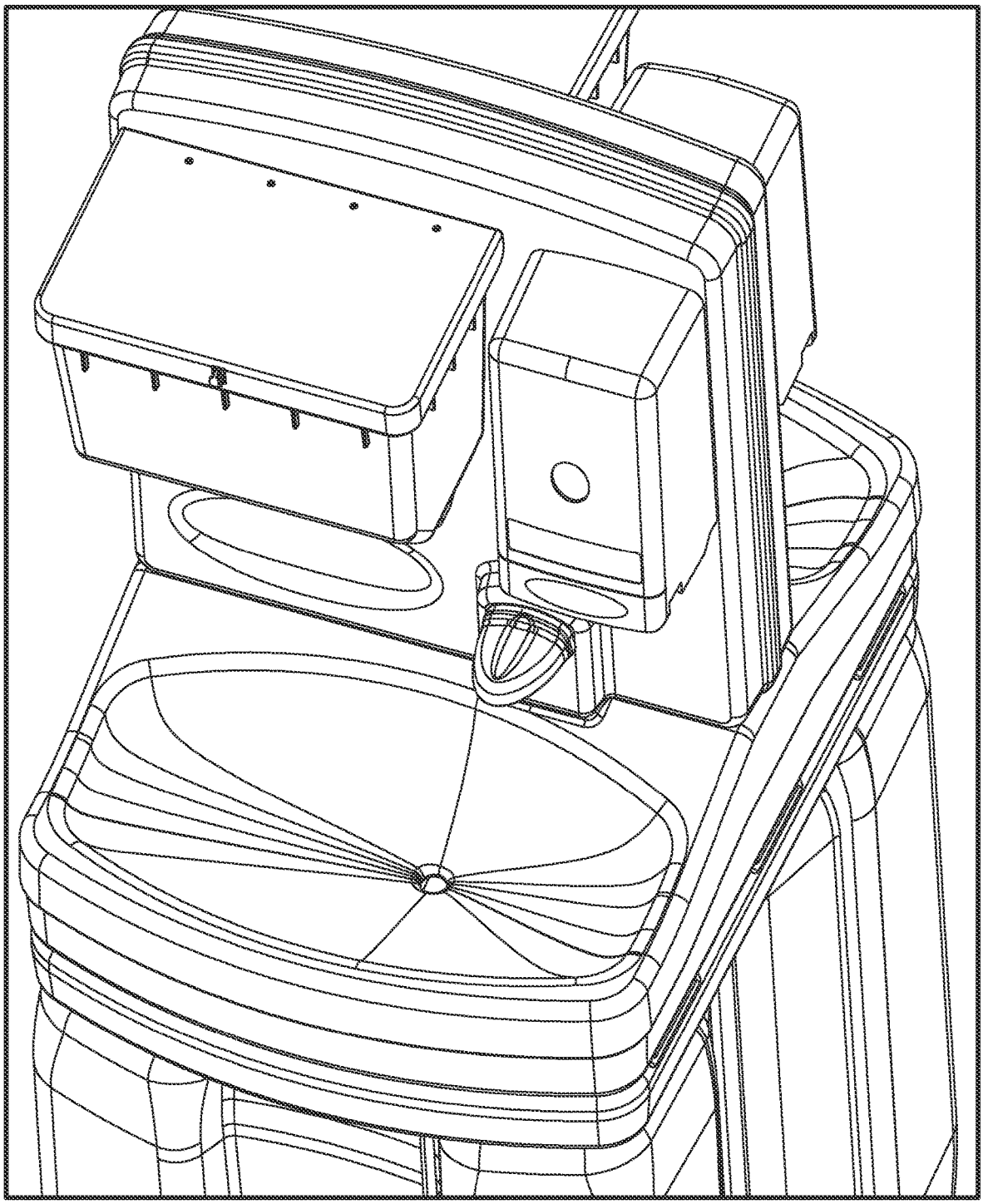
FIG. 9 is a partial perspective view of a hand wash station according to certain embodiments.
Figure 11:
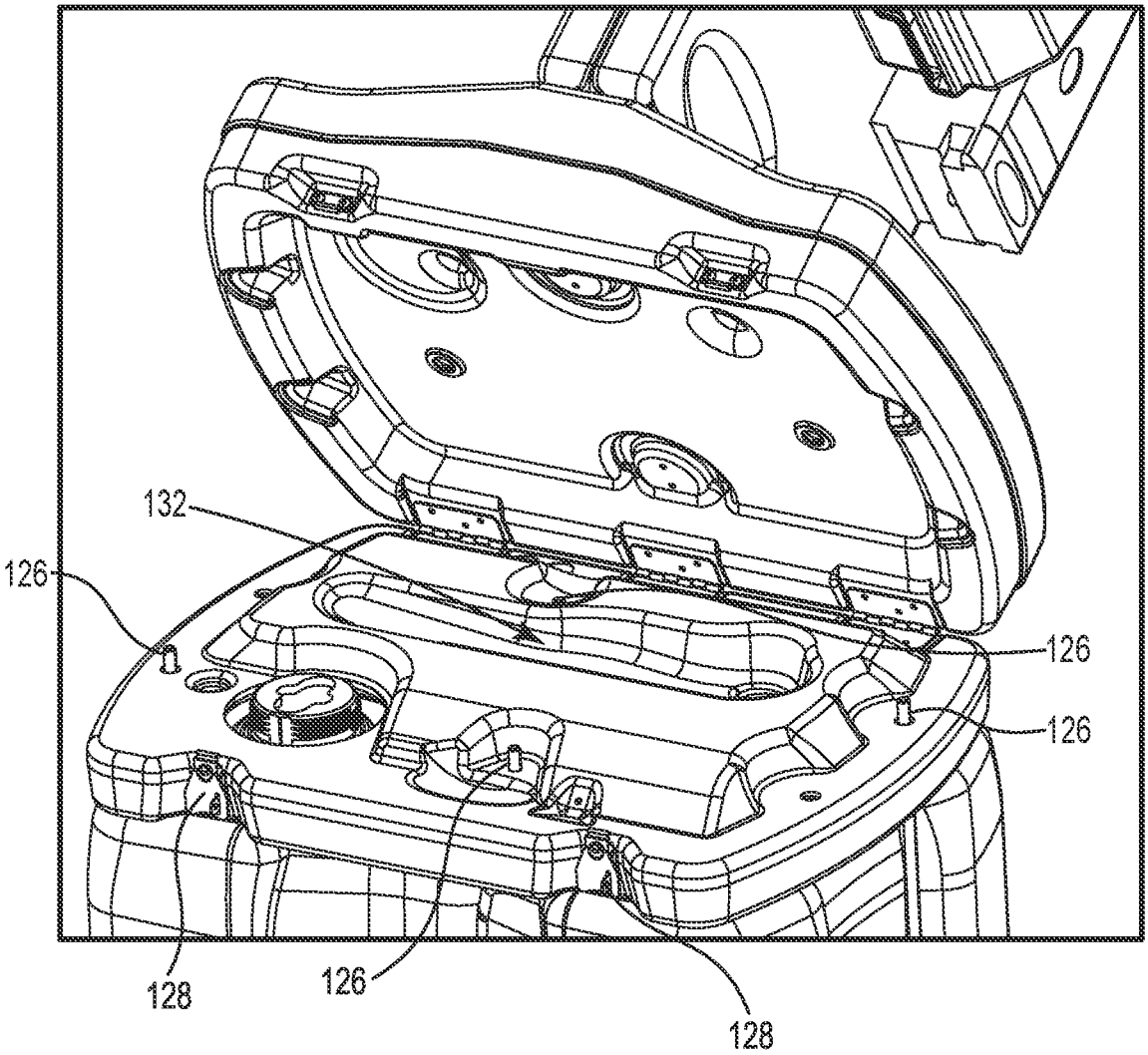
FIG. 11 is a partial perspective view of a hand wash station according to certain embodiments.

As can be seen in FIGS. 8 and 11, provisions are made for up to six rods 126 to be used to secure the tanks 104, 106, base 102 and tank cover 108 together. Each end of each rod 126 is threaded so that a threaded nut can be used as a fastener.

The provision of the rods 126 discussed above creates a strong assembly without the need for fasteners going into or through a side of the tanks 104, 106. This eliminates the possibility of tank leaks due to apertures necessary for the rods to pass through the sidewall of the tanks. In contrast, many conventional hand wash station designs have rods and/or fasteners passing through the tank sidewall, or that are molded into the tanks. These conventional configurations are prone to failure due to pulling out, stripping, cracking and/or leaking.

The hinged sink member can be secured in place atop the tank cover 108 to prevent users from accessing the fasteners, accessing the fresh water fill aperture, tampering with the hand wash station, and to improve aesthetics. For example, one or more rotary latches 128 are provided opposite the hinges 112 to allow the sink member 110 to be secured down on the tank cover 108. Thus, users cannot gain access to the fresh water tank and/or the fasteners for the rods 126. The latches 128 can be key-lockable or a padlock can be provided to enhance security.

Figure 10A:
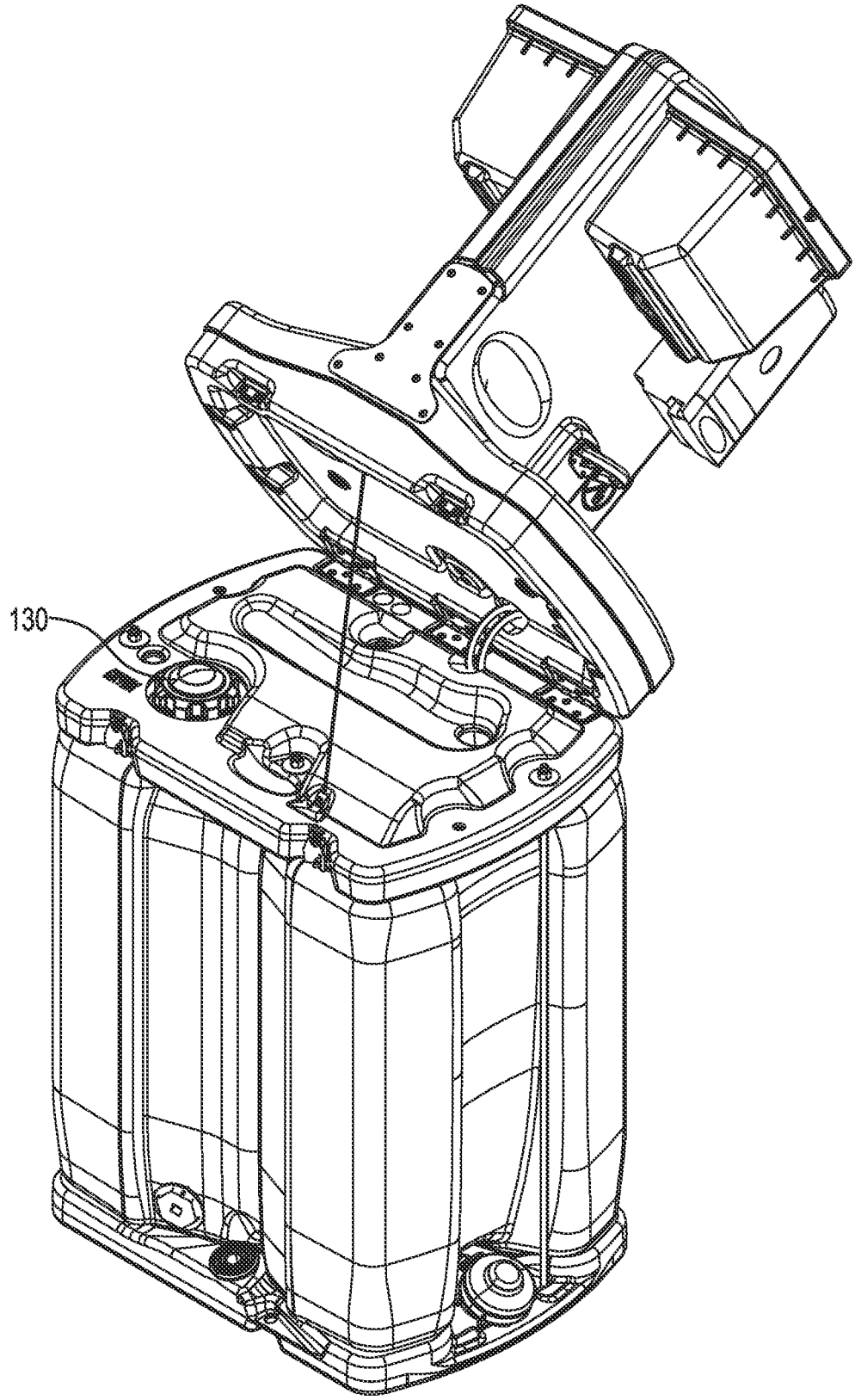
FIG. 10A is a perspective view of a hand wash station according to certain embodiments.

Referring to FIG. 10A, the fresh water fill cap 130 for the fresh water tank 104 is hidden by and protected by the hinged sink member 110. Thus, the fresh water tank is not accessible by public because it can be padlocked as described above. FIG. 11 shows the fresh water fill aperture after the cap is removed.

Figure 10B:
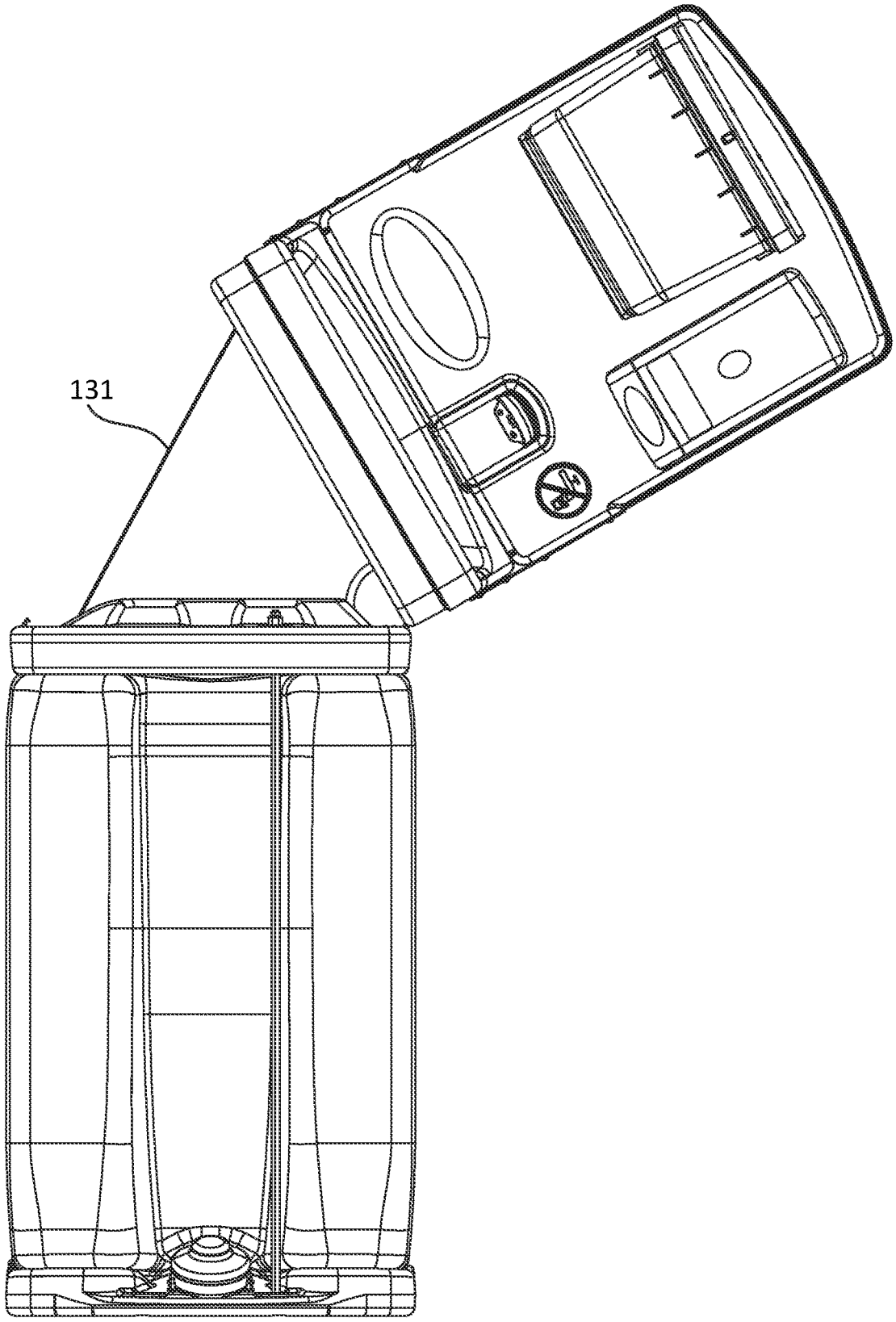
FIG. 10B is a side view of a hand wash station according to certain embodiments.

As shown in FIGS. 10A and 10B, a cable tether 131 can be provided between the tank cover 108 and the sink member 110 to keep the sink member 110 from pivoting too far (and possibly causing the portable sink to tip over) when the sink member 110 is pivoted open. The cable tether 131 is fastened through a bracket attached to the sink member 110 at the upper end and through the tank cover 108 at the lower end.

Also as can be seen in FIG. 11, the top side of the tank cover 108 defines a trough 132 into which both sink basins 114 drain. The trough 132 is positioned and sloped to drain both basins into the greywater (waste) tank 106. This configuration eliminates the need for separate hoses to route the drain waste water from each sink basin 114 into the greywater tank. This configuration also can catch debris that passes through the sink basins' drains before getting into the greywater waste tank 106.

Referring back to FIG. 2, both tanks 104, 106 include a threaded drain plug 133. The greywater tank 106 also includes a suction port 134 incorporated into the base 102.

Figure 2:
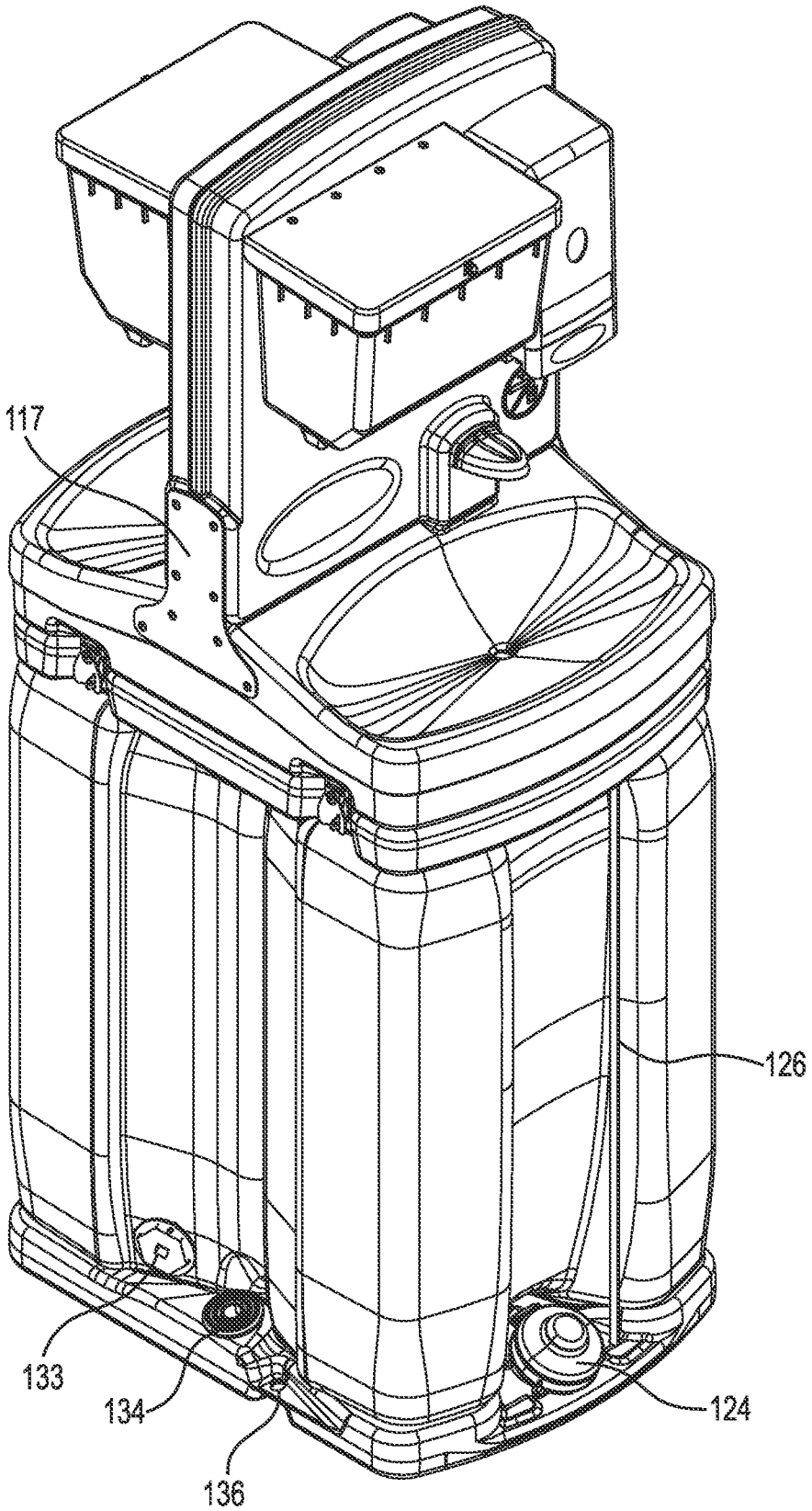
FIG. 2 is a perspective view of a hand wash station according to certain embodiments.
Figure 3:
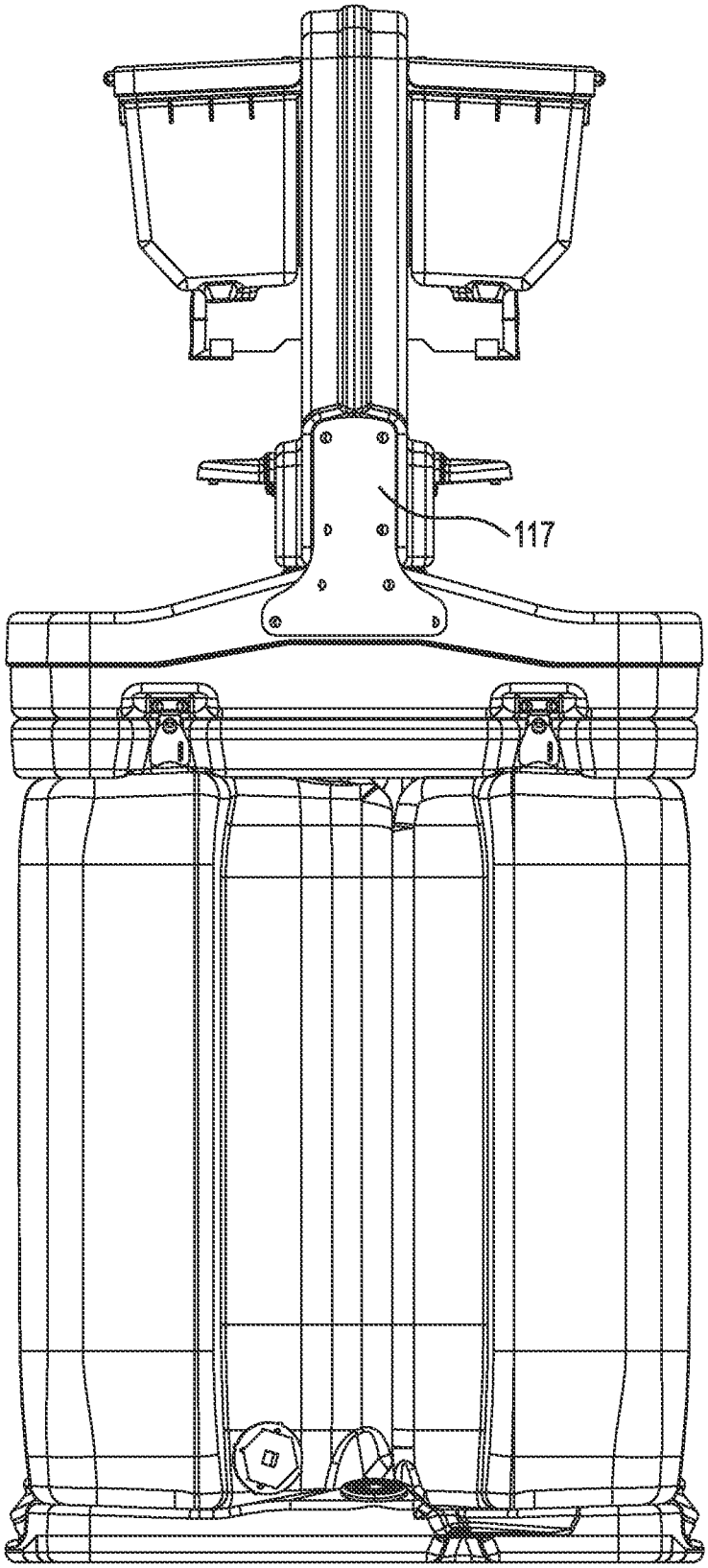
FIG. 3 is a side view of the hand wash station of FIG. 2 according to certain embodiments.
Figure 4:
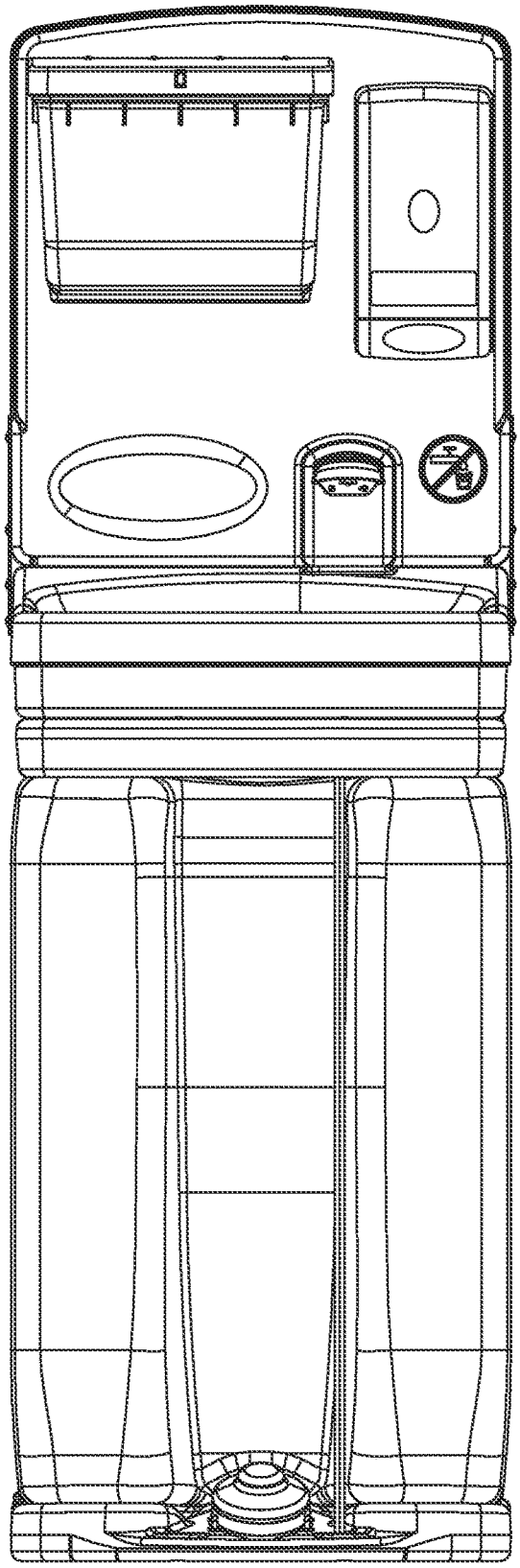
FIG. 4 is a front view of the hand wash station of FIG. 2 according to certain embodiments.
Figure 5:
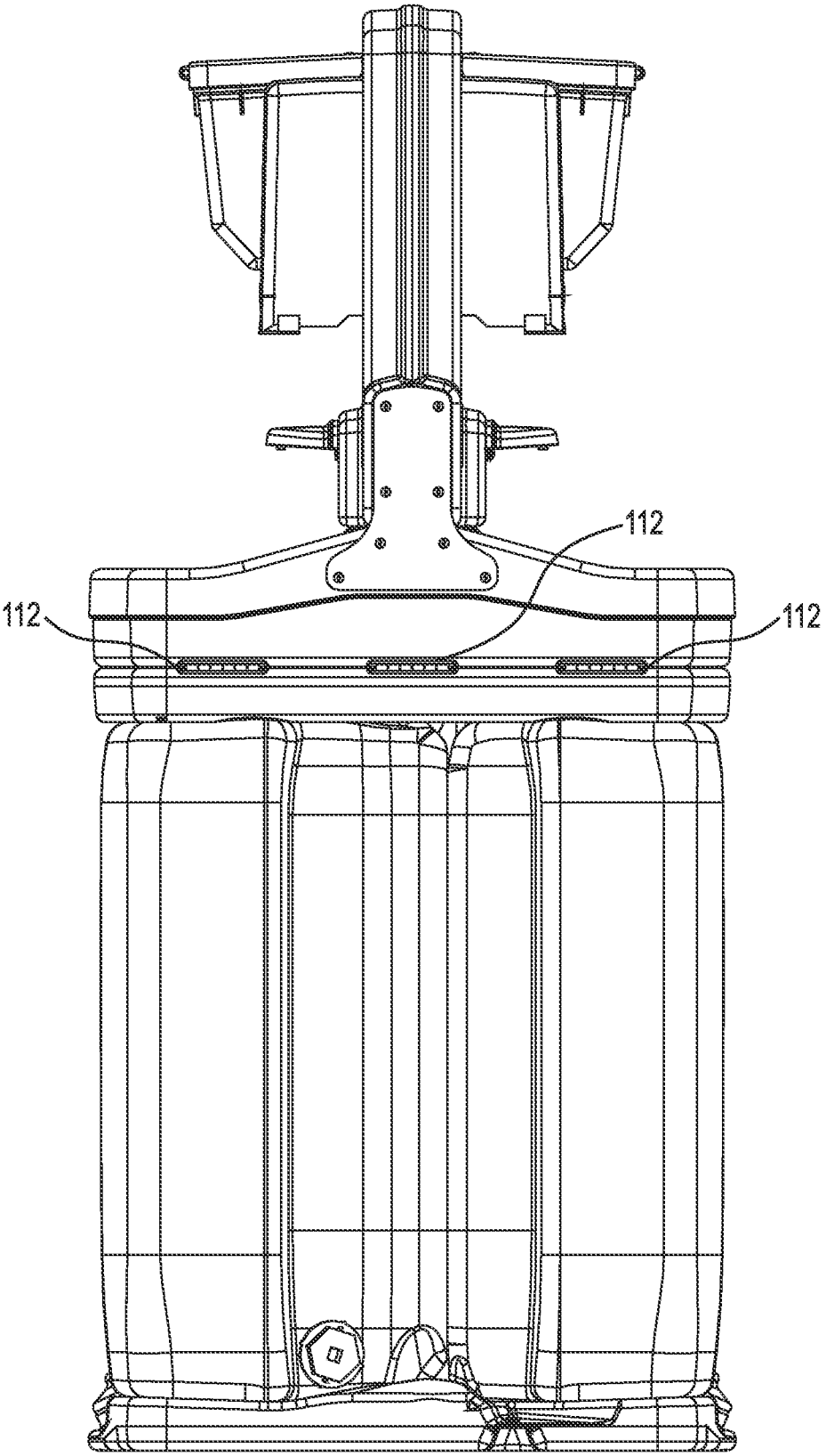
FIG. 5 is an opposing side view of the hand wash station of FIG. 2 according to certain embodiments.
Figure 6:
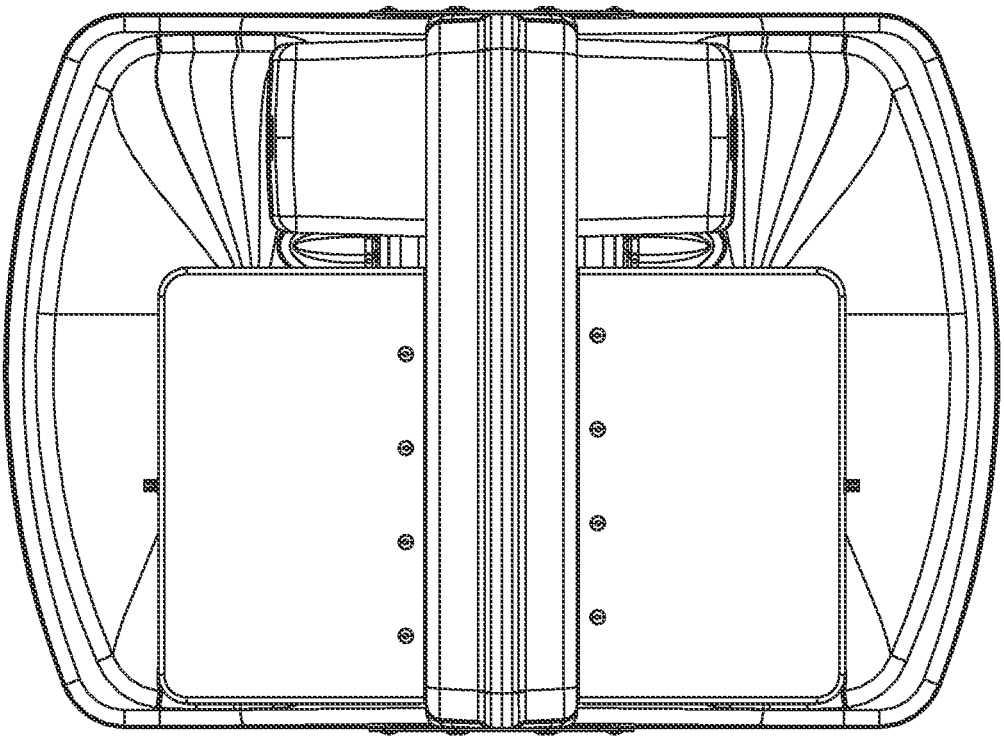
FIG. 6 is a top view of the hand wash station of FIG. 2 according to certain embodiments.
Figure 7:
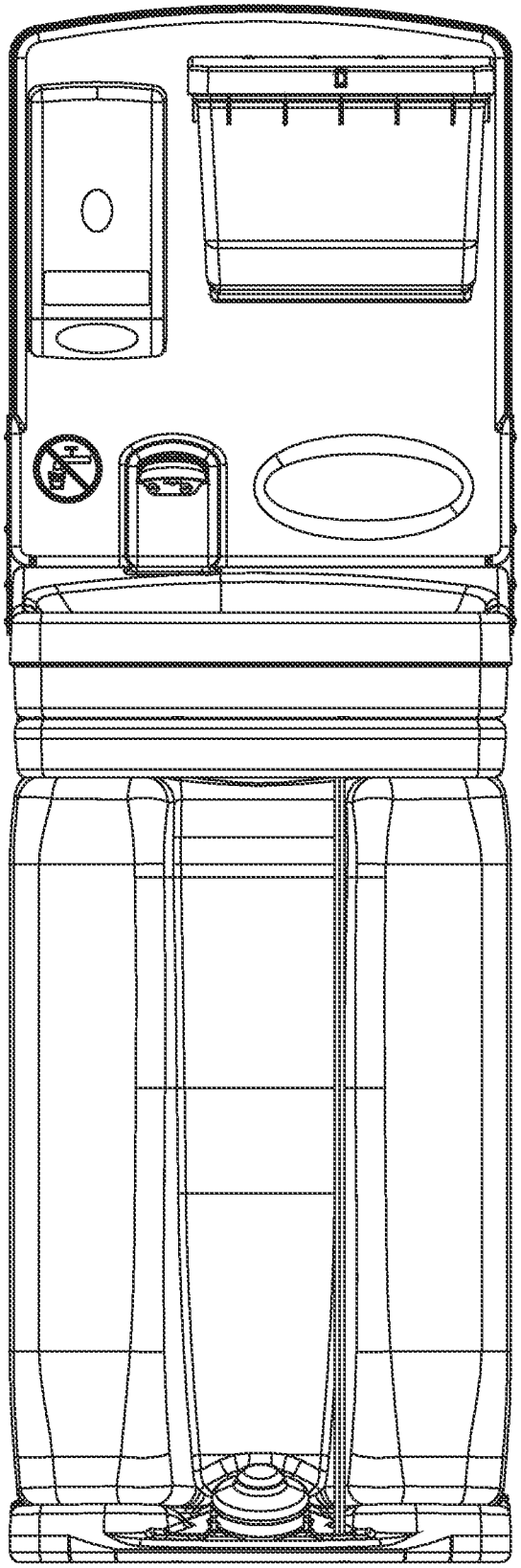
FIG. 7 is a rear view of the hand wash station of FIG. 2 according to certain embodiments.

As shown particularly in FIGS. 2 and 8, the base 102 defines two opposing stake-down holes 136 that can be used to secure or stabilize the hand wash station 100 in place atop the ground with stakes, nails or other fastener passing through the stake-down holes 136.

Figure 12:
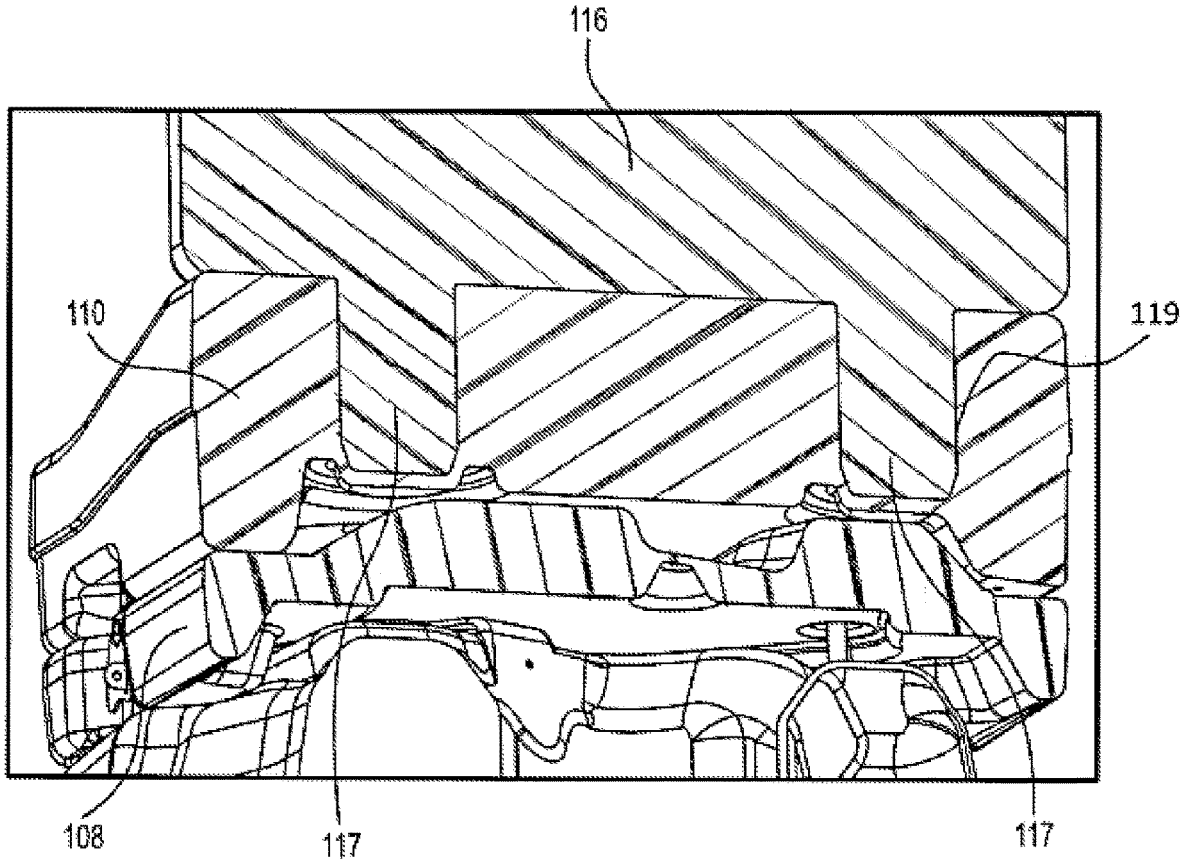
FIG. 12 is a perspective cross-sectional view of a hand wash station according to certain embodiments.

FIG. 12 illustrates the attachment of the backsplash member 116 to the sink member 110 in a cross-sectional view. The backsplash member 116 defines a pair of downwardly-protruding post portions 117. The sink member 110 defines corresponding recesses 119 to receive the respective downwardly-protruding post portions 117. Rivets can be used to secure the backsplash member 116 to the sink member 110. A rivet can be provided into each downward protruding post portion 117 of the backsplash member to fasten the backsplash to the respective recesses 119 in the sink member 110. The engagement of the downwardly-protruding post portions 117 into the respective recess 119 is at a slight interference fit to make a rigid structure.

FIG. 12 shows the backsplash member 116, the sink member 110 and tank top cover 108 parts as solid, but they can also be hollow parts.

Figure 13:
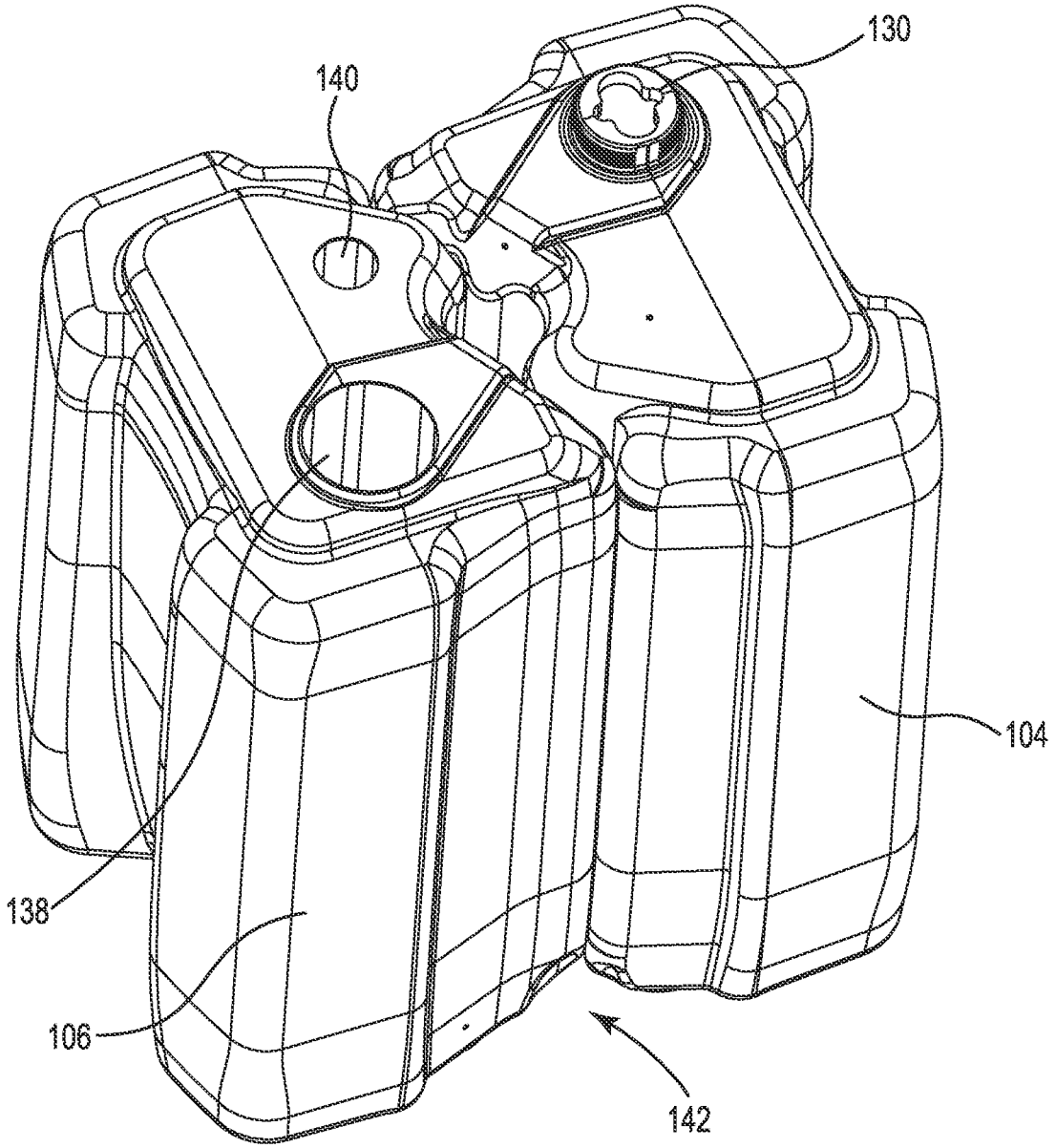
FIG. 13 is a perspective view of the tanks for a hand wash station according to certain embodiments.

FIG. 13 illustrates the two tanks 104 and 106. Both tanks are identical as they come out of the mold. They are then differentiated by receiving different trimming operations to make them either "fresh water" or "greywater" tanks. This allows use of two molds for manufacturing when demand is high, and only one mold when demand is low. This frees up a molding press for other products.

The fresh water tank 104 has a threaded neck that allows the fresh water fill cap 130 to be screwed on. The greywater tank 106 has this threaded neck cut off to leave an opening 138 into the tank. In addition, a smaller hole 140 allows routing the hose from the suction port into the waste water tank. The sink basins 114 drain into the opening 138 via the trough 132 in the tank cover 108 described above. The greywater tank 106 does not normally require a cap to seal the opening 138 because it is of little concern if the waste water is tampered with. There is a desire, however, to keep the fresh water protected. As described previously, the sink member 110 hinges open to provide access to the fresh water fill cap 130, while providing a way to lock the sink member 110 down to prevent tampering.

Portable hand wash stations are often located nearby portable restrooms. It is desirable to transport the portable hand wash stations to their destination while located inside of a portable restrooms because of the space savings. However, the size of some conventional hand wash stations prevents service persons from being able to transport the hand wash station inside the restroom because the toilet seat protrudes toward the doorway, which pushes the hand wash station forward such that the restroom's door cannot fully close.

Figure 14:
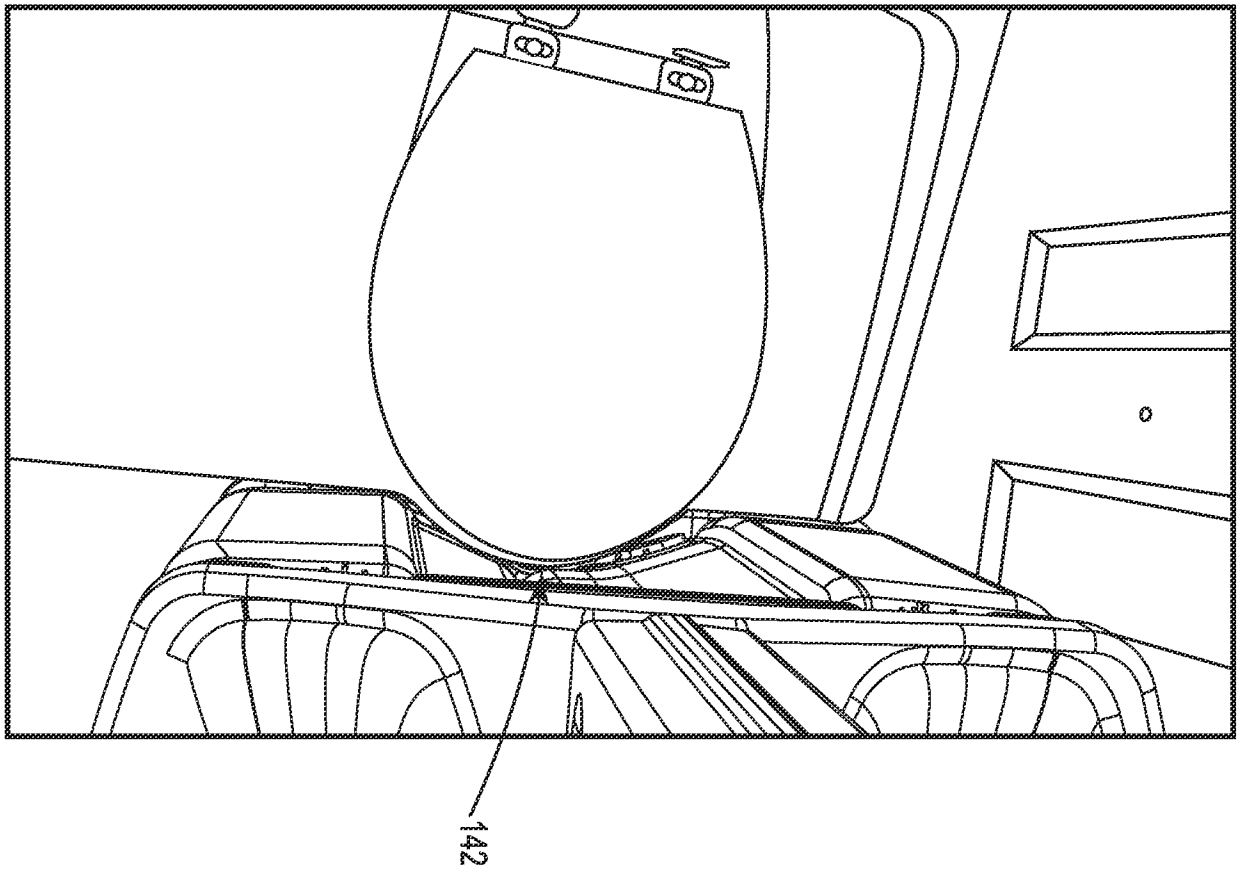
FIGS. 14-15 are perspective views of a hand wash station stored inside of a portable restroom according to certain embodiments.
Figure 15:
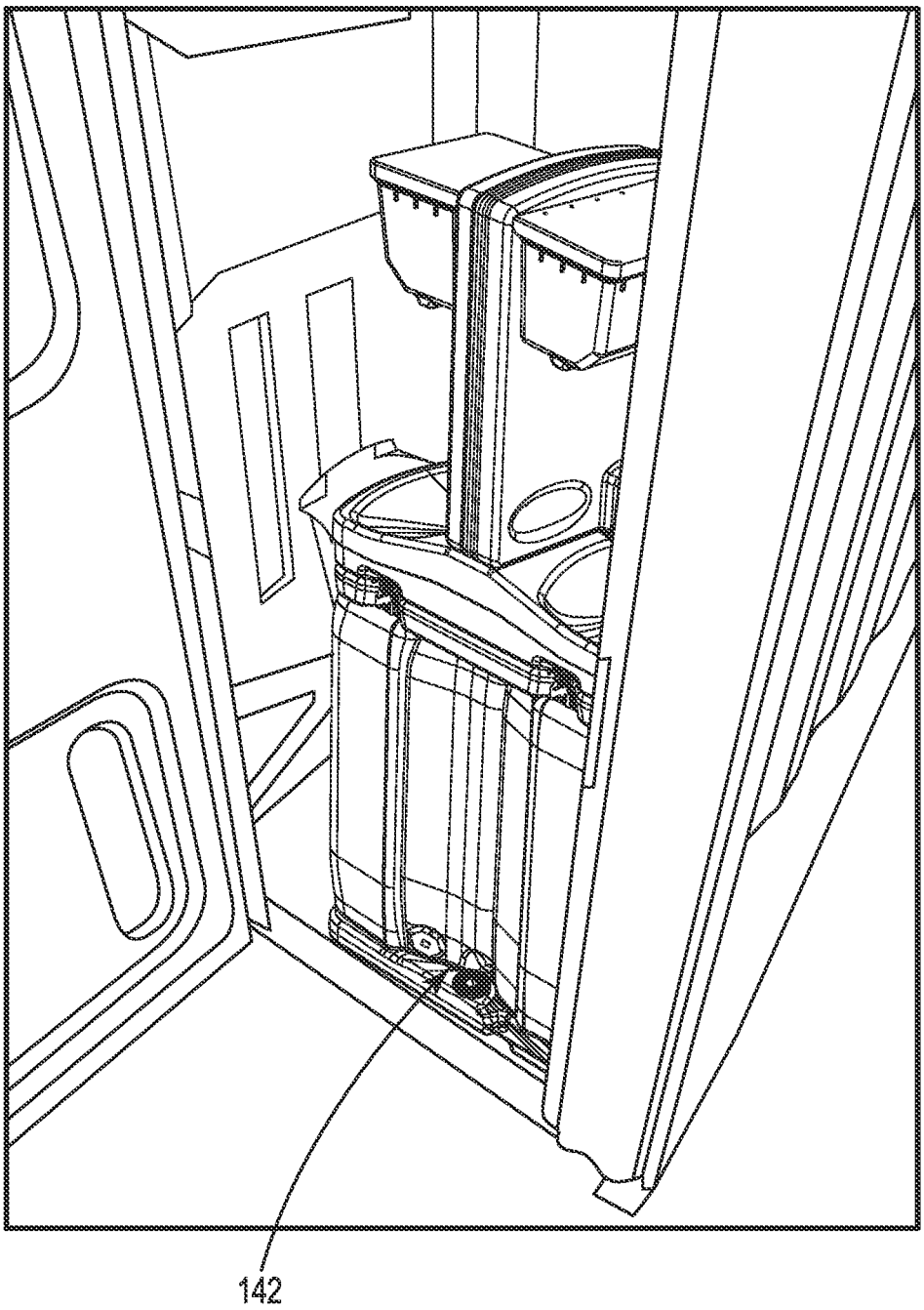

Referring to FIGS. 14-15, a further feature of certain embodiments of the hand wash station 100 is to define a recess 142 in the tanks 104, 106 to provide clearance for the toilet seat of a portable restroom to protrude inward of the outer perimeter of the hand wash station. This recess 142 allows the door of the restroom to close fully with the hand wash station disposed inside of the restroom. Thus the portable hand wash station can be transported inside of a conventional portable restroom.

The main components of the present hand wash station 100 (base 102, fresh water tank 104, greywater tank 106, tank cover 108, sink member 110, and backsplash member 116) are configured to be formed of a plastic material via a blow-molding process. This is advantageous because the blow-molding process allows for far more units per day to be produced versus the conventional roto-molding processes typically used for producing plastic components of conventional hand wash stations. Blow-molding provides greatly-increased speed of production over rotational molding. For example a single set of molds for the blow-molding process can produce parts five times faster than rotational molding.

Other features and aspects of the invention can be appreciated from the depictions in the figures, even if not described in writing herein.

While the invention has been described in connection with what is presently considered to be the most practical and preferred embodiments, it will be apparent to those of ordinary skill in the art that the invention is not to be limited to the disclosed embodiments. It will be readily apparent to those of ordinary skill in the art that many modifications and equivalent arrangements can be made thereof without departing from the spirit and scope of the present disclosure, such scope to be accorded the broadest interpretation of the appended claims so as to encompass all equivalent structures and products. Moreover, features or aspects of various example embodiments may be mixed and matched (even if such combination is not explicitly described herein) without departing from the scope of the invention.

What is claimed is:

1. A portable hand wash station, comprising:

a base;

a fresh water tank disposed atop the base;

a greywater tank disposed atop the base and horizontally adjacent to the fresh water tank;

a tank cover disposed atop the fresh water tank and the greywater tank; and a plurality of elongated rods spanning from the tank cover to the base to secure the fresh water tank and the greywater tank in place atop the base, wherein the plurality of elongated rods never pass through a sidewall of either the fresh water tank or the greywater tank.

2. The portable hand wash station of claim 1, further comprising a sink member pivotally secured to the tank cover.

3. The portable hand wash station of claim 2, further comprising a backsplash member secured to the sink member, wherein the backsplash member defines a plurality of downwardly-protruding post portions, wherein the sink member defines a plurality of recesses, and wherein each of the plurality of downwardly-protruding post portions is sized and shaped to mate with a respective one of the plurality of recesses.

4. The portable hand wash station of claim 3, further comprising a towel holder, a soap dispenser and/or or a hand sanitizer dispenser mounted to the backsplash member.

5. The portable hand wash station of claim 2, wherein a fresh water fill cap disposed in a top surface of the fresh water tank protrudes vertically through the tank cover while being covered by the sink member when the sink member is in a non-pivoted state with respect to the tank cover.

6. The portable hand wash station of claim 2, further comprising a locking latch arranged to secure the sink member such that the sink member cannot pivot with respect to the tank cover.

7. The portable hand wash station of claim 2, further comprising a tether secured to a top side of the tank cover and to the sink member, the tether defining a maximum pivot range of the sink member with respect to the tank cover.

8. The portable hand wash station of claim 2, wherein the sink member defines a pair of sink basins, and wherein the tank cover defines a trough that is arranged such that water from the pair of sink basis drains directly into the trough and the trough routes the water to a greywater inlet of the greywater tank.

9. The portable hand wash station of claim 1, further comprising a first foot pump provided to the base on a first side and a second foot pump provided to the base on a second side that is opposite the first side.

10. The portable hand wash station of claim 1, wherein each of the fresh water tank and the greywater tank are configured to define an outwardly-facing recess in a sidewall to provide clearance for a portion of a toilet seat when the portable hand wash station is placed inside of a portable restroom with a door of the portable restroom closed.

11. A portable hand wash station, comprising:

a base;

a fresh water tank disposed atop the base;

a greywater tank disposed atop the base and horizontally adjacent to the fresh water tank;

a tank cover disposed atop the fresh water tank and the greywater tank; and a sink member pivotally secured to the tank cover, the sink member including a pair of sink basins, wherein the tank cover defines a common trough that is arranged such that water that drains from each sink basin of the pair of sink basis drains directly into the common trough and the common trough routes the water into a greywater inlet of the greywater tank.

12. The portable hand wash station of claim 11, wherein a fresh water fill cap disposed in a top surface of the fresh water tank protrudes vertically through the tank cover while being covered by the sink member when the sink member is in a non-pivoted state with respect to the tank cover.

13. The portable hand wash station of claim 11, further comprising a locking latch arranged to secure the sink member such that the sink member cannot pivot with respect to the tank cover.

14. The portable hand wash station of claim 11, further comprising a tether secured to a top side of the tank cover and to the sink member, the tether defining a maximum pivot range of the sink member with respect to the tank cover.

15. The portable hand wash station of claim 11, wherein each of the fresh water tank and the greywater tank are configured to define an outwardly-facing recess in a sidewall to provide clearance for a portion of a toilet seat when the portable hand wash station is placed inside of a portable restroom with a door of the portable restroom closed.

16. A portable hand wash station, comprising:

a base;

a fresh water tank disposed atop the base;

a greywater tank disposed atop the base and horizontally adjacent to the fresh water tank;

a tank cover disposed atop the fresh water tank and the greywater tank; and a sink member pivotally secured to the tank cover, wherein the fresh water tank comprises a fresh water fill inlet sealable with a cap, and wherein the fresh water fill cap protrudes vertically upward through the tank cover while being covered by the sink member when the sink member is in a non-pivoted state with respect to the tank cover.

17. The portable hand wash station of claim 16, further comprising a plurality of elongated rods spanning from the tank cover to the base to secure the fresh water tank and the greywater tank in place atop the base, wherein the plurality of elongated rods never pass through a sidewall of either the fresh water tank or the greywater tank.

18. The portable hand wash station of claim 16, further comprising a locking latch arranged to secure the sink member such that the sink member cannot pivot with respect to the tank cover.

19. The portable hand wash station of claim 16, further comprising a tether secured to a top side of the tank cover and to the sink member, the tether defining a maximum pivot range of the sink member with respect to the tank cover.

20. The portable hand wash station of claim 16, wherein each of the fresh water tank and the greywater tank are configured to define an outwardly-facing recess in a sidewall to provide clearance for a portion of a toilet seat when the portable hand wash station is placed inside of a portable restroom with a door of the portable restroom closed.

* * * * *